US010766755B2

(12) United States Patent
Bencista' Falorni

(10) Patent No.: US 10,766,755 B2
(45) Date of Patent: Sep. 8, 2020

(54) APPARATUS FOR DISPENSING BEVERAGES BY THE GLASS PROVIDED WITH SPACE-SAVING CONTAINER

(71) Applicant: ENOMATIC S.R.L., Greve in Chianti (IT)

(72) Inventor: Gianni Bencista' Falorni, Greve in Chianti (IT)

( * ) Notice: Subject to any disclaimer, the term of this patent is extended or adjusted under 35 U.S.C. 154(b) by 0 days.

(21) Appl. No.: 15/792,844

(22) Filed: Oct. 25, 2017

(65) Prior Publication Data

US 2018/0111813 A1 Apr. 26, 2018

(30) Foreign Application Priority Data

Oct. 25, 2016 (IT) ..... 102016000107213

(51) Int. Cl.
*B67D 1/00* (2006.01)
*B67D 1/08* (2006.01)
*B67D 1/04* (2006.01)

(52) U.S. Cl.
CPC ..... *B67D 1/0004* (2013.01); *B67D 1/04* (2013.01); *B67D 1/0412* (2013.01); *B67D 1/0842* (2013.01); *B67D 1/0891* (2013.01); *B67D 2001/0095* (2013.01); *B67D 2210/00031* (2013.01); *B67D 2210/00034* (2013.01)

(58) Field of Classification Search
CPC .. B67D 1/0004; B67D 1/0412; B67D 1/0842; B67D 1/0891; B67D 2210/00034
USPC ..... 222/270
See application file for complete search history.

(56) References Cited

U.S. PATENT DOCUMENTS

D259,725 S * 6/1981 Wasserstrom ..... D7/308
6,123,226 A * 9/2000 Giattino ..... B67D 3/0029 222/144.5
2003/0098314 A1* 5/2003 Phelps ..... F25D 31/007 222/1
2008/0277422 A1* 11/2008 Sommerfield ..... B67D 1/0412 222/152
2009/0218365 A1* 9/2009 Taradalsky ..... B67D 1/0885 222/1
2011/0000250 A1* 1/2011 Sommerfield ..... B67D 1/0412 62/391
2011/0042458 A1* 2/2011 Falci ..... B67D 1/04 235/381
2011/0253746 A1* 10/2011 O'Keefe, Jr. ..... B67D 1/0005 222/132
2014/0299630 A1* 10/2014 Brown ..... B67D 1/06 222/129.1

FOREIGN PATENT DOCUMENTS

EP 1241127 A1 * 9/2002 ..... B67D 3/0029
WO WO-9214978 A1 * 9/1992 ..... B67D 3/0009
WO WO-2014191908 A1 * 12/2014 ..... B67D 1/0412

* cited by examiner

*Primary Examiner* — Jeremy Carroll
(74) *Attorney, Agent, or Firm* — Abelman, Frayne & Schwab; Stefan Knirr

(57) ABSTRACT

An apparatus for the automatic dispensing of beverages by the glass is provided with space-saving container adapted to be installed and implemented so as to allow an optimized occupation of the available spaces.

3 Claims, 8 Drawing Sheets

APPARATUS FOR DISPENSING BEVERAGES BY THE GLASS PROVIDED WITH SPACE-SAVING CONTAINER

FIELD OF THE INVENTION

The present invention relates to the field of apparatuses for automatically dispensing beverages; in particular, to the field of containers for said apparatuses for automatically dispensing beverages.

BACKGROUND ART

Devices and apparatuses are known from the prior art which are adapted to automatically dispense beverages from containers such as bottles and the like. Some of these devices and apparatuses are such whereby the bottles or the similar vessels are kept in upside down position and dispense the beverage contained therein by means of conveniently opening a valve which allows the falling by gravity of the beverage into a container conveniently positioned at the mouth of the vessel.

Others provide the bottles, or the similar vessels, to be kept in vertical position, resting on the bottom thereof, and dispensing the beverage by means of two tubes introduced into the bottle through the bottle cap. An inert gas is blown into the bottle through one of the aforesaid tubes, thus keeping the beverage pressurized. When the dispensing tap associated with a tube is opened, the pressurized gas allows dispensing the beverage through the other tube. Devices and apparatuses of this second type are particularly suitable in all those cases, such as e.g. in the case of wine, in which the beverage contained in the bottle would suffer a decline of its organoleptic quality due to the upside down position of the bottle.

Said devices and apparatuses adapted to automatically dispense beverages from containers such as bottles and the like generally comprise a container adapted to contain the bottles and vessels from which the liquid is to be drawn, said container being provided with a resting base, preferably placed on the lower side of the container and associated with mobile lifting means possibly provided with manually, mechanically, electrically or pneumatically activated actuators, and a tap block, adapted to engage the opening of a bottle or similar vessel for beverages and to adjust the release of the beverage contained therein.

The implementation of these apparatuses for dispensing beverages by the glass provides arranging and connecting the hook up to the electric network, the inert gas distribution network or to an external cylinder containing said inert gas, and possibly to the Internet or local data network, in the place where the apparatus will operate.

Dispensing apparatuses of this type are especially used in wine shops, restaurants, coffee shops, and may be adapted to contain a number of bottles which typically goes from 2 or 3 to 6 or 8. Often, especially in wine shops, wine bars, sampling rooms and the like, a plurality of apparatuses of this type is used. Given the significant volume characterizing the containers of the dispensing apparatuses involved, it is apparent that using a plurality of them may result in the problem of occupying significant space in areas which have limited spaces. Moreover, the shape of the containers of the dispensing apparatuses of beverages by the glass of the prior art does not allow any flexibility of use when installation spaces have an irregular development or particular needs for adaptation to structures or parts of pre-existing furnishings.

The present invention allows the aforesaid drawbacks to be overcome by introducing an apparatus for the automatic dispensing of beverages by the glass comprising a space-saving container adapted to be installed and implemented, especially together with other apparatuses provided with containers of the same type, so as to allow an optimized occupation of the available spaces.

BRIEF DESCRIPTION OF THE DRAWINGS

Further objects, features and advantages of the present invention will become more apparent from the following detailed description, provided by way of non-limiting example and illustrated in the accompanying drawings, in which.

SUMMARY OF THE INVENTION

Figure 1:
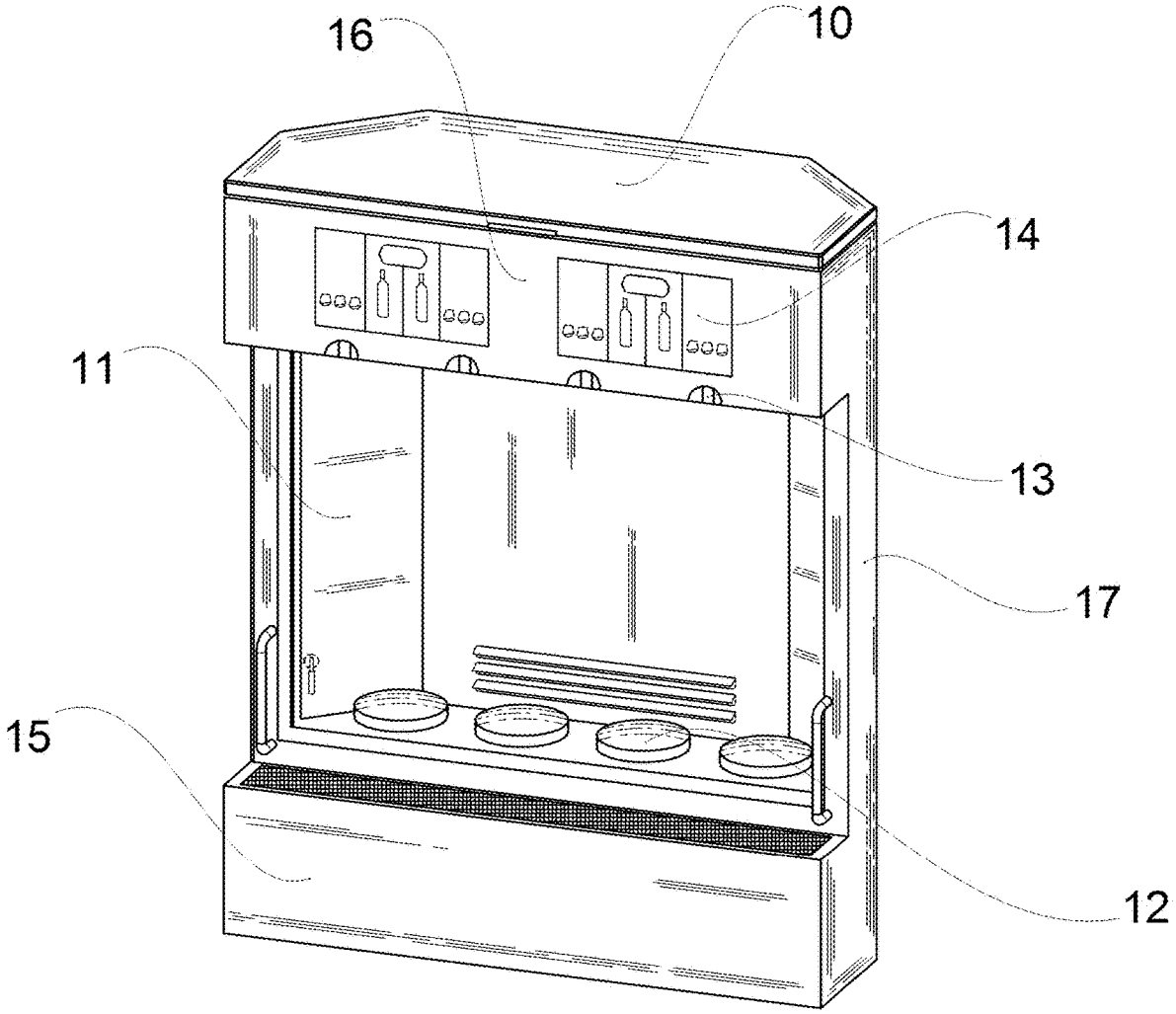
FIG. 1 shows a perspective view of an embodiment of the apparatus for dispensing beverages by the glass, according to the present invention.
Figure 2:
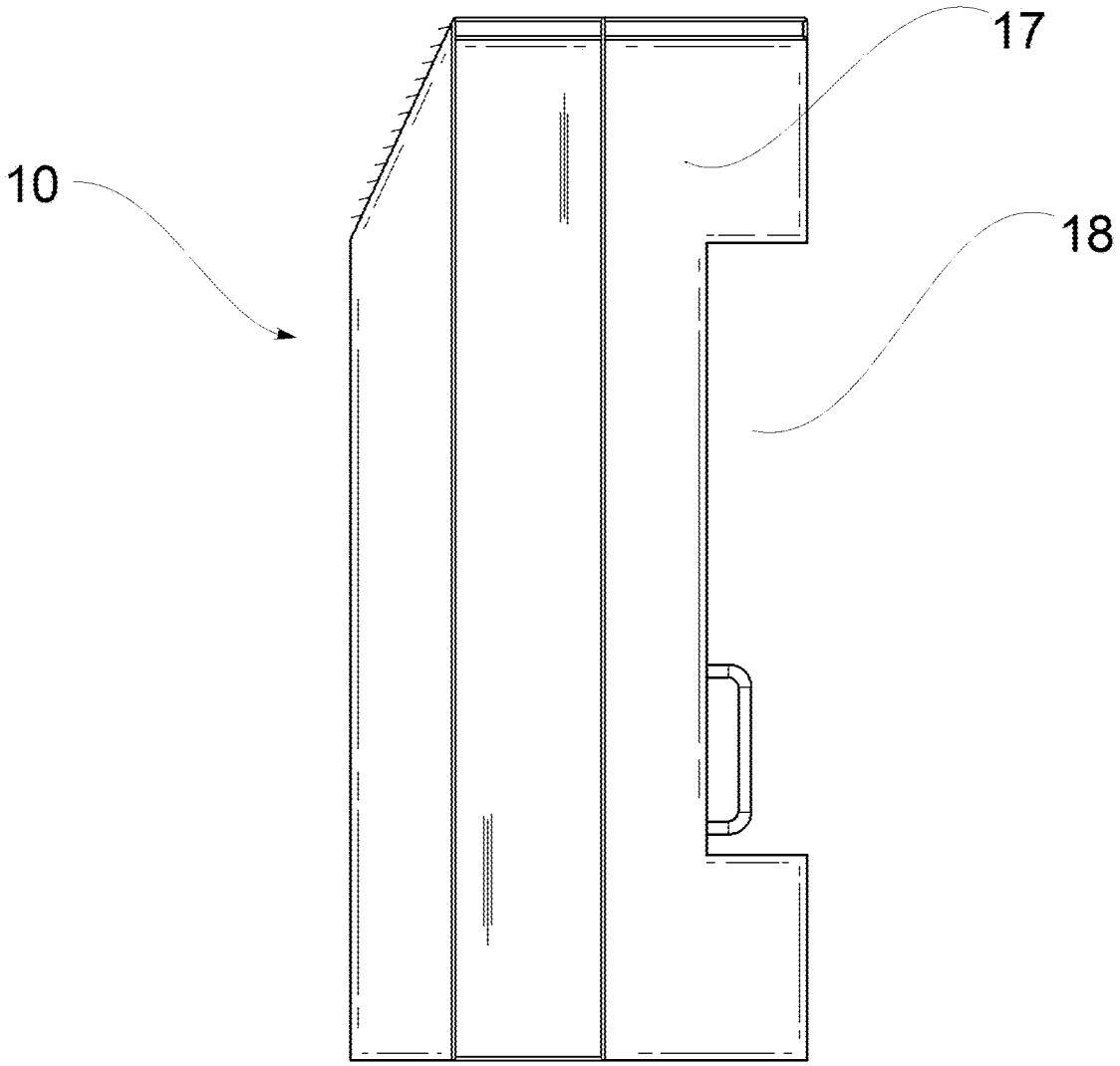
FIG. 2 shows a side view of an embodiment of the apparatus for dispensing beverages by the glass, according to the present invention.
Figure 3:
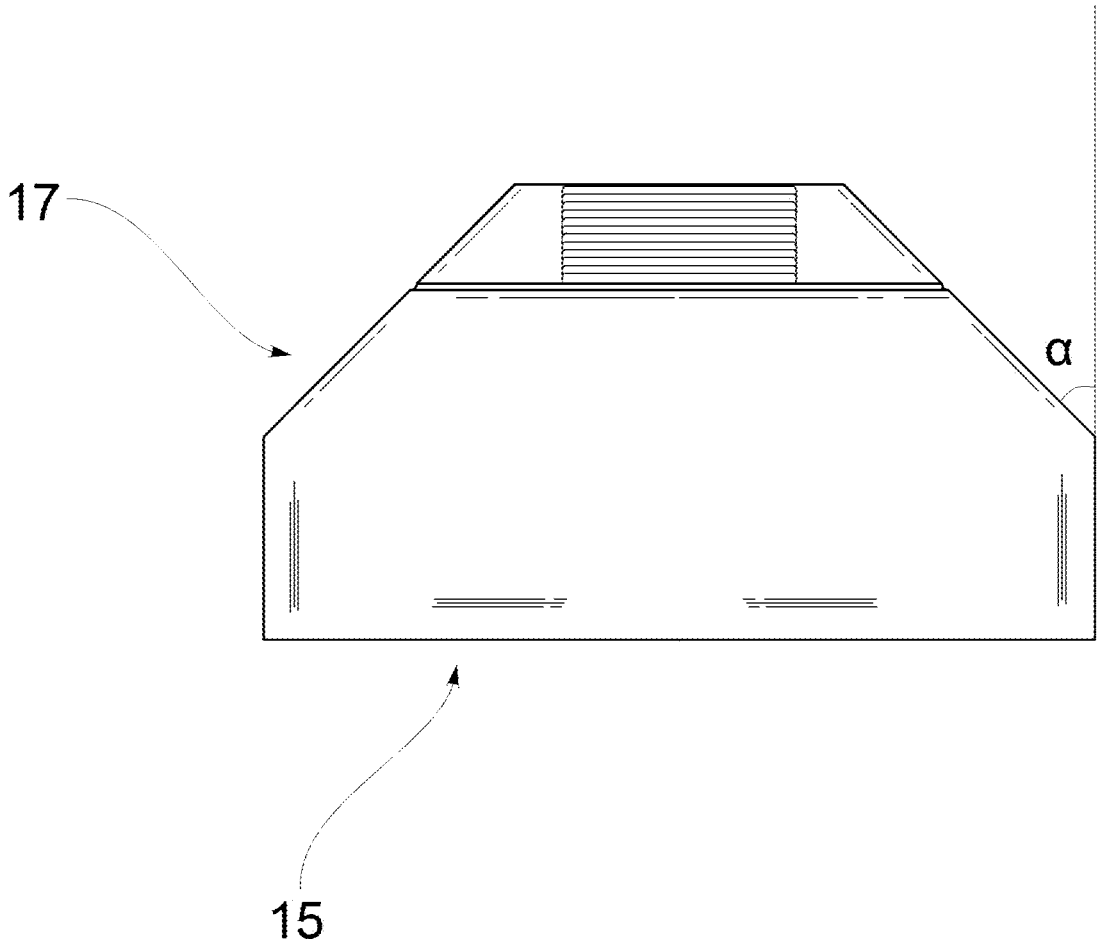
FIG. 3 shows a top view of an embodiment of the apparatus for dispensing beverages by the glass, according to the present invention.
Figure 4:
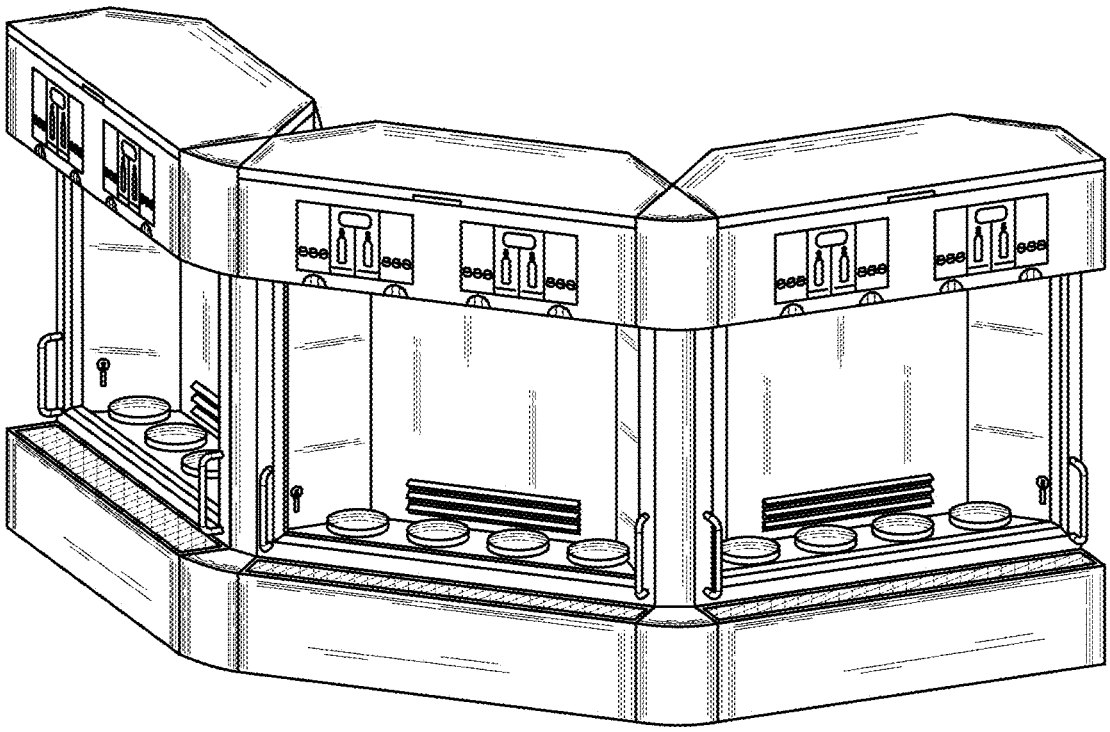
FIG. 4 shows a perspective view of 3 apparatuses for dispensing beverages by the glass arranged in an arc, according to the present invention.
Figure 5:
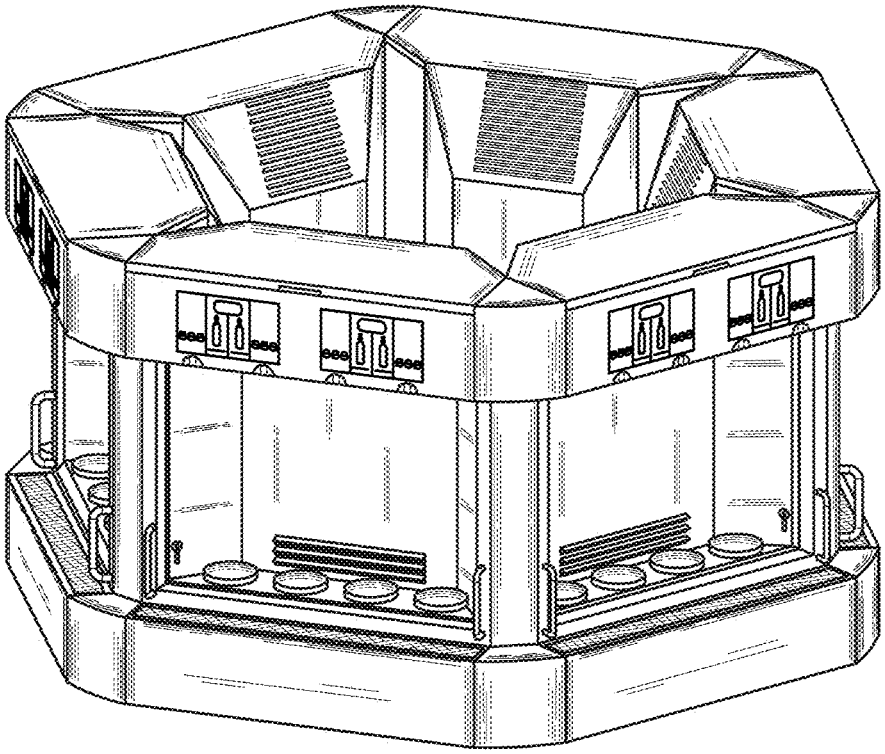
FIG. 5 shows a perspective view of 6 apparatuses for dispensing beverages by the glass arranged in a circle, according to the present invention.
Figure 6:
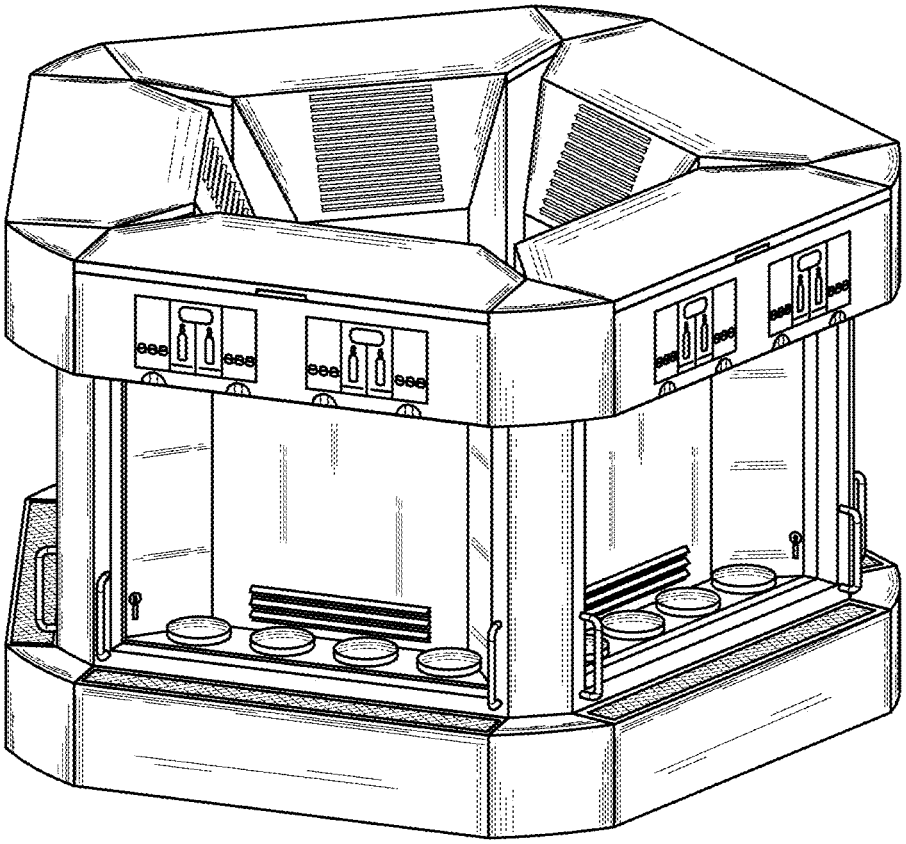
FIG. 6 shows a perspective view of 5 apparatuses for dispensing beverages by the glass arranged in a circle, according to the present invention.
Figure 7:
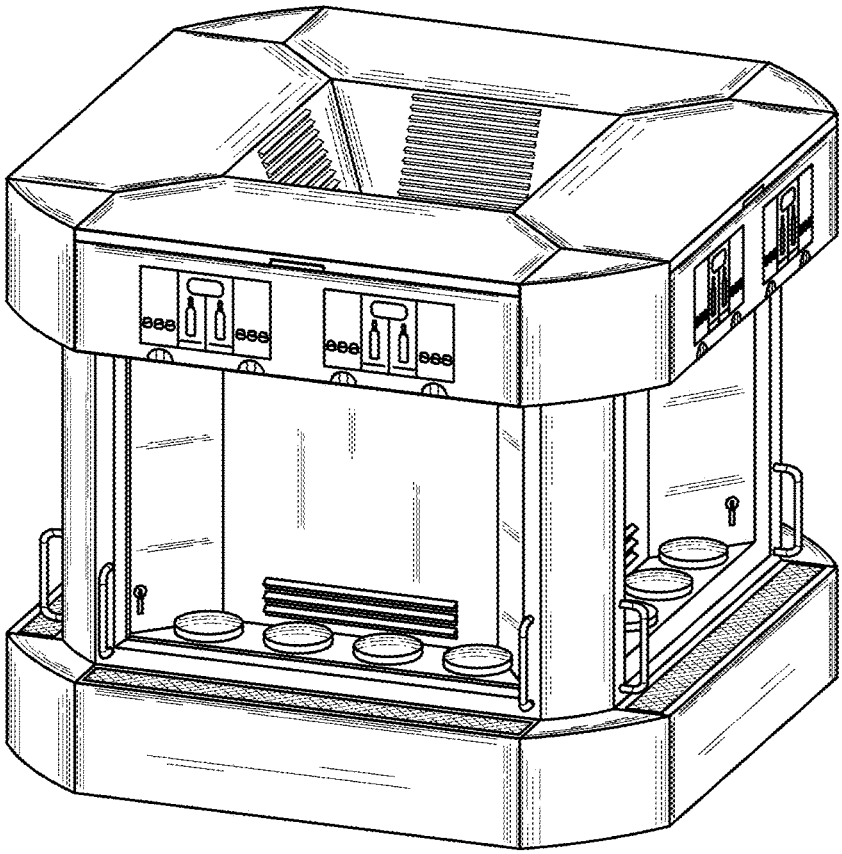
FIG. 7 shows a perspective view of 4 apparatuses for dispensing beverages by the glass arranged in a circle, according to the present invention.
Figure 8:
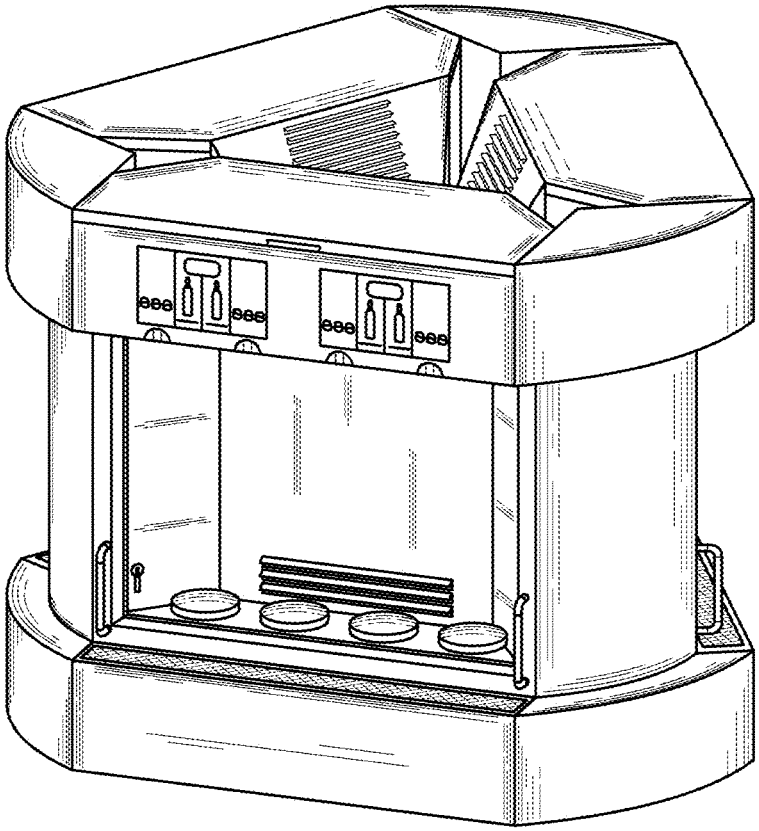
FIG. 8 shows a perspective view of 3 apparatuses for dispensing beverages by the glass arranged in a circle, according to the present invention.

An apparatus for the automatic dispensing of beverages by the glass is provided with space-saving container adapted to be installed and implemented so as to allow an optimized occupation of the available spaces. Said space-saving container comprises at least one lateral side having at least one part which is inclined with respect to the plane normal to the lying plane of the front side of the container. The apparatus for the automatic dispensing of beverages by the glass according to the present invention in particular allows arranging a plurality of said dispensing apparatuses according to different configurations adapted to optimize the occupation of space of the apparatuses, also in conditions of installation spaces having an irregular development or particular needs for adaptation to structures or parts of pre-existing furnishings.

DETAILED DESCRIPTION OF THE INVENTION

The following description of embodiments refers to the accompanying drawings. Equal reference numerals recurring throughout the various drawings depict similar or identical elements. The following detailed description does not limit the invention. Contrarily, the field of application of the invention is defined by the claims in the appendix.

The reference in the entire detailed description to an "embodiment" or a "preferred embodiment" means that a particular feature, structure or property feature described in relation to an embodiment is included in at least one embodiment of the object disclosed. Therefore, the use of the expression "in an embodiment" in various points of the detailed description does not necessarily refer to the same embodiment. Moreover, the particular features, structures or properties may be combined in any suitable manner in one or more embodiments.

In reference to accompanying FIG. 1, the automatic beverage dispensing apparatus according to the present invention comprises a container 10, comprising an inner compartment 11 adapted to contain the bottles and vessels from which the liquid of said beverages is to be drawn. Said inner compartment is provided with at least one resting base 12 for said bottles and said vessels, preferably arranged on the lower side of said container 10; there are also present dispensing means adapted to allow the liquid of said beverages to be drawn from said bottles and vessels, preferably by means of blowing inert gas.

Typically, said dispensing means comprise a tap block 13, adapted to engage with the opening of a bottle or similar vessel for beverages and to regulate the discharge therefrom of the beverage contained therein; possible thermal conditioning means of said container 10, adapted to keep the temperature at a controlled value; control and driving means associated with said dispensing means, with said thermal conditioning means and with means for controlling and managing the performed dispensing operation comprising in turn user interface means 14; electric supply means adapted to supply, if required, voltage and electric operating current to the various components of the device according to the present invention.

Said tap block 13 may be advantageously made as described in European Patent EP1352873 and in international Patent Application WO2012000978 by the same applicant of the present patent application.

The resting base 12 may possibly be provided with centering devices like the ones the object of European Patent EP3003961 by the same applicant of the present patent application. Said at least one resting base 12 also may possibly comprise mobile lifting means provided with manually, mechanically, electrically or pneumatically operated actuators associated with said control and driving means, or may be associated with resistant elastic means adapted to oppose a thrust such as to lower said resting base 12 and accordingly to push upwards the bottle placed on said resting base 12, thus exerting a pressure thereon such as to lower it. Said means for controlling and managing the performed dispensing operation from said device may be further adapted: to collect all the operating data of the device according to the present invention, to adjust said operation thereof according to the current settings and to communicate information to the user concerning the operation and any alarm conditions through the user interface means 14.

In reference to accompanying FIG. 1, container 10 of the apparatus according to the present invention comprises:

a front side 15 comprising an access opening to the inner compartment, adapted to contain the bottles and vessels from which the liquid of said beverages is to be drawn, and a panel 16 comprising said user interface 14;

two lateral sides, of which at least one lateral side 17 having at least one part which is inclined with respect to the plane normal to the lying plane of the front side of the container. In a preferred embodiment of the present invention, both the lateral sides 17 have at least one part which lies on a plane inclined by a given angle $\alpha$ with respect to the plane normal to the lying plane of the front side of the container, said angle $\alpha$ being comprised between 0° and 90° and preferably comprised between 30° and 60°.

In reference to accompanying FIGS. 4 to 8, the container of the apparatus according to the present invention, and in particular the lateral sides of said container, allow a plurality of apparatuses to be juxtaposed by facing the inclined parts of the lateral sides thereof. Thereby, the plurality of dispensing apparatuses may be arranged in an arc, as shown in accompanying FIG. 4, when for example, it becomes necessary to adapt the arrangement of the apparatuses to a curved wall. The plurality of dispensing apparatuses may also be arranged in a circle, as shown in accompanying FIGS. 5 to 8, when for example, it becomes necessary to arrange the apparatuses about a column or when a multiple dispensing station accessible by users on all sides, is to be created.

The container of the automatic beverage dispensing apparatus according to the present invention allows increased flexibility to be obtained in positioning a plurality of said apparatuses and the machines to be accessed from various directions rather than from one direction only. To this end, the part of the lateral side lying on a plane normal to the lying plane of the front side of the container advantageously may provide a recess 18 at said access opening to the inner compartment of container 10, said recess being adapted to increase the lateral visibility of the inner compartment of said container if the apparatuses according to the present invention are juxtaposed in the manners described above and shown in accompanying FIGS. 4 to 8.

The invention claimed is:

1. A plurality of apparatuses for the automatic dispensing of beverages, each apparatus comprising a container of a same type comprising an inner compartment adapted to contain bottles and vessels from which the liquid is to be drawn, said inner compartment being provided with at least one resting base for said bottles; a dispenser comprising a tap block arranged above the at least one resting base, said tap block adapted to engage the opening of a bottle or similar vessel for beverages and to adjust the release of the beverage contained therein, wherein said container comprises:

a front side comprising an access opening to the inner compartment and a panel comprising said user interface;

two lateral sides, of which at least one lateral side comprises a first part which lies on a plane normal to the front side of the container and a second part which lies on a plane inclined by a given angle a with respect to the first part, said angle $\alpha$ being greater than 0° and less than 90°, said first and second parts respectively extending along an entirety of a vertical extent of the apparatus, the two lateral sides of the container allowing the plurality of apparatuses to be juxtaposed by facing the inclined parts of the lateral sides thereof such that the plurality of apparatuses may be arranged in an arc or a circle.

2. The plurality of apparatuses according to claim 1, wherein the first part of both of the lateral sides of said container comprises a recess at the access opening to the inner compartment of said container.

3. The plurality of apparatuses according to claim 1, wherein said angle $\alpha$ is comprised between 30° and 60°.

* * * * *